US010823420B2

(12) United States Patent
Camponovo et al.

(10) Patent No.: US 10,823,420 B2
(45) Date of Patent: Nov. 3, 2020

(54) PILOT NOZZLE WITH INLINE PREMIXING

(71) Applicant: General Electric Company, Schenectady, NY (US)

(72) Inventors: Simone Roberto Walter Camponovo, Wettingen (CH); Fulvio Magni, Nussbaumen (CH); Ewald Freitag, Boppelsen (CH); John Philip Wood, Rutihof (CH); Andre Theuer, Baden (CH); Rohit Kulkarni, Villnachern (CH)

(73) Assignee: General Electric Technology GmbH, Baden (CH)

( * ) Notice: Subject to any disclaimer, the term of this patent is extended or adjusted under 35 U.S.C. 154(b) by 214 days.

(21) Appl. No.: 16/025,660

(22) Filed: Jul. 2, 2018

(65) Prior Publication Data

US 2019/0011132 A1 Jan. 10, 2019

(30) Foreign Application Priority Data

Jul. 4, 2017 (EP) ..... 17179478

(51) Int. Cl.

| | |
|---|---|
| ***F23R 3/34*** | (2006.01) |
| ***F23R 3/28*** | (2006.01) |
| ***F23R 3/50*** | (2006.01) |
| ***F23D 14/62*** | (2006.01) |

(52) U.S. Cl.

CPC ..... *F23R 3/343* (2013.01); *F23D 14/62* (2013.01); *F23R 3/286* (2013.01); *F23R 3/34* (2013.01); *F23R 3/50* (2013.01); *F23R 2900/03343* (2013.01)

(58) Field of Classification Search

CPC .. F23R 3/286; F23R 3/34; F23R 3/343; F23R 2900/03343; F23D 14/62; F23D 14/64

See application file for complete search history.

(56) References Cited

U.S. PATENT DOCUMENTS

| | | | | |
|---|---|---|---|---|
| 6,161,387 | A * | 12/2000 | Green | F23R 3/14 60/742 |
| 6,367,262 | B1 * | 4/2002 | Mongia | F23R 3/14 60/748 |
| 6,418,726 | B1 | 7/2002 | Foust et al. | |
| 2005/0164138 | A1 * | 7/2005 | Ruck | F23D 17/002 431/2 |

(Continued)

FOREIGN PATENT DOCUMENTS

| | | |
|---|---|---|
| EP | 2161502 A1 | 3/2010 |

*Primary Examiner* — Steven M Sutherland

(74) *Attorney, Agent, or Firm* — Charlotte C. Wilson; James W. Pemrick

(57) ABSTRACT

A burner for a combustor of a turbomachine includes a pilot nozzle with inline premixing. The pilot nozzle is formed in an aft end of the burner. An air inlet is formed in a forward end of the burner in fluid communication with the pilot nozzle. A mixing channel extends along the axial direction between the air inlet and the pilot nozzle such that the air inlet is in fluid communication with the pilot nozzle via the mixing channel. An annular fuel plenum extends along the circumferential direction. A fuel port is in fluid communication with the annular fuel plenum and the mixing channel, the fuel port includes an outlet configured to inject fuel into the mixing channel such that a shear flow is induced.

18 Claims, 9 Drawing Sheets

(56) References Cited

U.S. PATENT DOCUMENTS

| | | | | |
|---|---|---|---|---|
| 2007/0137207 | A1* | 6/2007 | Mancini | F23R 3/14 60/737 |
| 2015/0316266 | A1* | 11/2015 | Prade | F23N 5/16 60/776 |
| 2016/0146460 | A1 | 5/2016 | Stewart et al. | |
| 2017/0082290 | A1 | 3/2017 | Stewart | |
| 2017/0089582 | A1* | 3/2017 | Carrotte | F02C 3/04 |

* cited by examiner

PILOT NOZZLE WITH INLINE PREMIXING

TECHNICAL FIELD

The present disclosure generally involves a burner for a combustor section of a turbomachine. More specifically, the disclosure relates to a burner having a pilot nozzle with inline premixing.

BACKGROUND OF THE INVENTION

As requirements for gas turbine emissions have become more stringent, one approach to meeting such requirements is to move from diffusion flame combustors to combustors utilizing lean fuel and air mixtures using a premixed operation to reduce emissions of, for example, nitrogen oxides (NOx). These combustors are generally known in the art as Dry Low NOx (DLN), Dry Low Emissions (DLE) or Lean Pre Mixed (LPM) combustion systems.

A combustor section of a turbomachine such as a gas turbine may include a plurality of burners. Certain burners include a plurality of pilot nozzles which are annularly arranged around a primary nozzle. The primary nozzle may be configured to utilize premixed fuel and air to provide reduced emissions, as described above. However, premixed lean combustion operation may result in flame instability. Accordingly, conventional burners include diffusion pilots annularly arranged about the primary nozzle. The diffusion pilots inject a rich fuel or pure fuel, that is, the diffusion pilots have no air intake or fuel/air mixing structure, such that typical burners include pilot nozzles which inject fuel with little or no air intermixed therein. Although the diffusion pilots stabilize the premixed primary flame, the diffusion pilots produce most of the total NOx emissions from such systems.

BRIEF DESCRIPTION

Aspects and advantages are set forth below in the following description, or may be obvious from the description, or may be learned through practice.

One embodiment is a burner for a turbomachine. The burner includes a central axis. The central axis of the burner defines an axial direction, a radial direction perpendicular to the central axis, and a circumferential direction extending around the central axis. The burner also includes a pilot nozzle formed proximate to an aft end of the burner. An air inlet is formed proximate to a forward end of the burner in fluid communication with the pilot nozzle. A mixing channel extends along the axial direction between the air inlet and the pilot nozzle such that the air inlet is in fluid communication with the pilot nozzle via the mixing channel. An annular fuel plenum extends along the circumferential direction. A fuel port is in fluid communication with the annular fuel plenum and the mixing channel. The fuel port includes an outlet configured to inject fuel into the mixing channel such that a shear flow is induced.

Another embodiment of the present disclosure is a gas turbine. The gas turbine includes a compressor, a turbine downstream from the compressor, and a combustor disposed downstream from the compressor and upstream from the turbine. The combustor includes a plurality of burners. Each burner includes at least one pilot nozzle formed proximate to an aft end of the burner. At least one air inlet is formed proximate to a forward end of the burner in fluid communication with the pilot nozzle. A mixing channel extends along the axial direction between the air inlet and the pilot nozzle such that the air inlet is in fluid communication with the pilot nozzle via the mixing channel. An annular fuel plenum extends along the circumferential direction. A fuel port is in fluid communication with the annular fuel plenum and the mixing channel. The fuel port includes an outlet configured to inject fuel into the mixing channel such that a shear flow is induced.

Those of ordinary skill in the art will better appreciate the features and aspects of such embodiments, and others, upon review of the specification.

BRIEF DESCRIPTION OF THE DRAWINGS

A full and enabling disclosure of the present embodiments, including the best mode thereof to one skilled in the art, is set forth more particularly in the remainder of the specification, including reference to the accompanying figures, in which.

DETAILED DESCRIPTION

Figure 1:
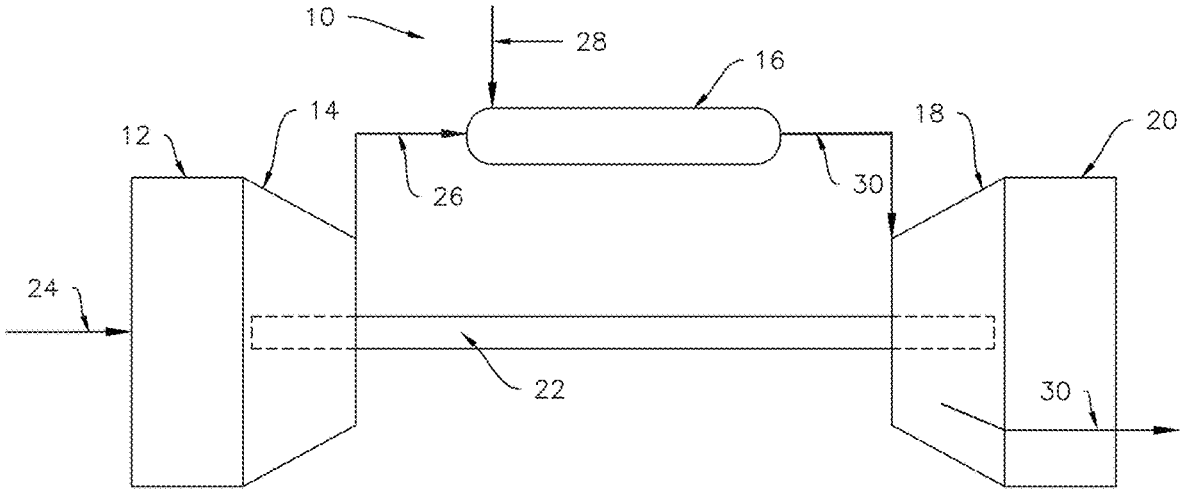
FIG. 1 illustrates a schematic depiction of an embodiment of a gas turbine.

Reference will now be made in detail to present embodiments of the disclosure, one or more examples of which are illustrated in the accompanying drawings. The detailed description uses numerical and letter designations to refer to features in the drawings. Like or similar designations in the drawings and description have been used to refer to like or similar parts of the disclosure.

As used herein, the terms "first", "second", and "third" may be used interchangeably to distinguish one component from another and are not intended to signify location or importance of the individual components. The terms "upstream" or "forward" and "downstream" or "aft" refer to the relative direction with respect to fluid flow in a fluid pathway. For example, "upstream" refers to the direction from which the fluid flows, and "downstream" refers to the direction to which the fluid flows. The term "radially" refers to the relative direction that is substantially perpendicular to an axial centerline of a particular component, and the term "axially" refers to the relative direction that is substantially parallel and/or coaxially aligned to an axial centerline of a particular component.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Each example is provided by way of explanation, not limitation. In fact, it will be apparent to those skilled in the art that modifications and variations can be made without departing from the scope or spirit thereof. For instance, features illustrated or described as part of one embodiment may be used on another embodiment to yield a still further embodiment. Thus, it is intended that the present disclosure covers such modifications and variations as come within the scope of the appended claims and their equivalents. Although exemplary embodiments of the present disclosure will be described generally in the context of a combustor for a land based power generating gas turbine for purposes of illustration, one of ordinary skill in the art will readily appreciate that embodiments of the present disclosure may be applied to any style or type of combustor for a turbomachine and are not limited to combustors or combustion systems for land based power generating gas turbines unless specifically recited in the claims.

Referring to the drawings, FIG. 1 illustrates a schematic depiction of a gas turbine 10. The gas turbine 10 generally includes an inlet section 12, a compressor 14 disposed downstream of the inlet section 12, a combustor section 16 disposed downstream of the compressor 14, a turbine 18 disposed downstream of the combustor section 16 and an exhaust section 20 disposed downstream of the turbine 18. Additionally, the gas turbine 10 may include one or more shafts 22 that couple the compressor 14 to the turbine 18. Additionally, the gas turbine 10 might include one or more combustors 16 and one or more turbines 18.

During operation, air 24 flows through the inlet section 12 and into the compressor 14 where the air 24 is progressively compressed, thus providing compressed air 26 to the combustor 16. At least a portion of the compressed air 26 is mixed with a fuel 28 within the combustor 16 and burned to produce combustion gases 30. The combustion gases 30 flow from the combustor 16 into the turbine 18, wherein energy (kinetic and/or thermal) is transferred from the combustion gases 30 to rotor blades (not shown), thus causing shaft 22 to rotate. The mechanical rotational energy may then be used for various purposes such as to generate mechanical torque, to power the compressor 14, and/or to generate electricity. The combustion gases 30 exiting the turbine 18 may then be exhausted from the gas turbine 10 via the exhaust section 20.

Figure 2:
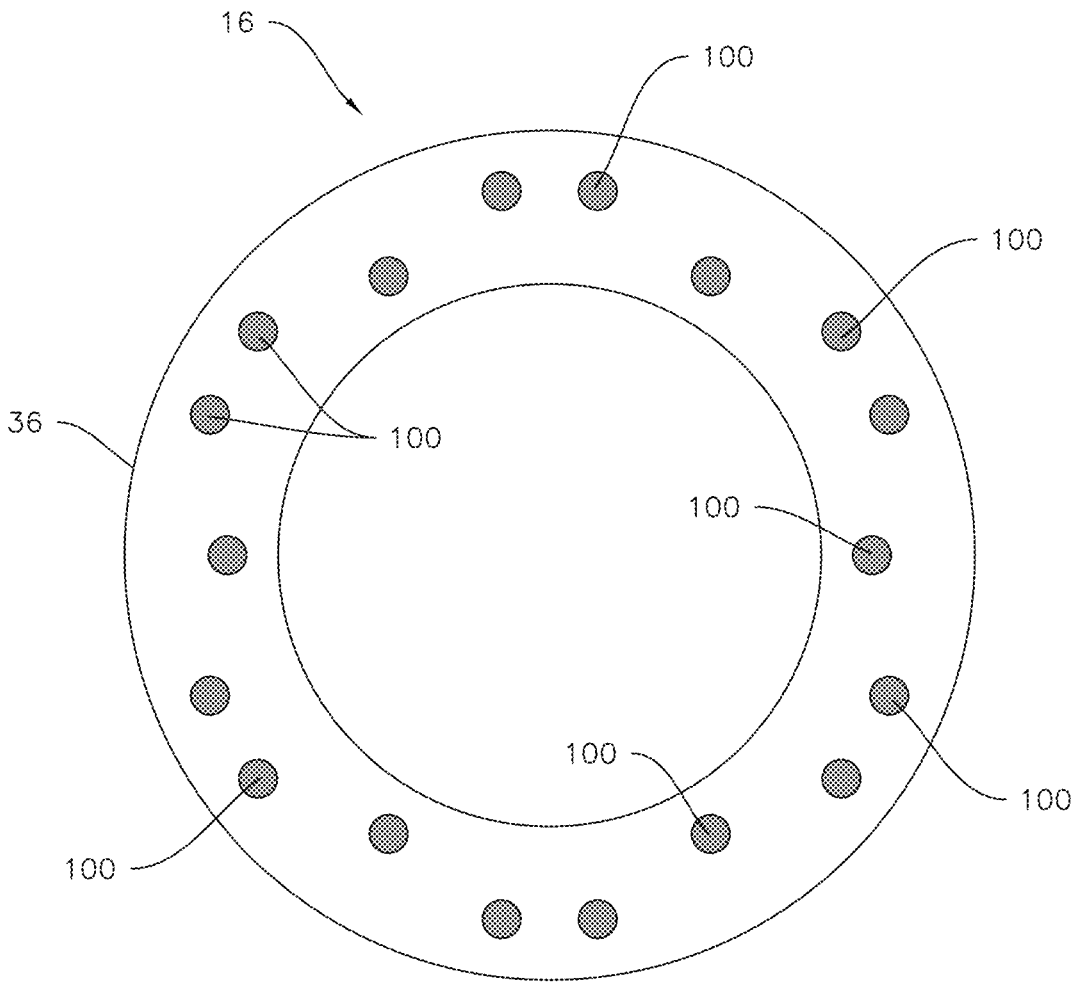
FIG. 2 is a view looking upstream at an exemplary combustor section according to at least one embodiment.

As shown in FIG. 2, the combustor 16 may include a combustor hood 36 which forms an annulus extending around the gas turbine 10 (FIG. 1). Also as shown in FIG. 2, a plurality of burners 100 may be circumferentially spaced along the annular combustor 16 within the combustor hood 36. Various embodiments of the combustor 16 may include different numbers and arrangements of burners and is not limited to any particular number of burners unless otherwise specified in the claims.

Figure 3:
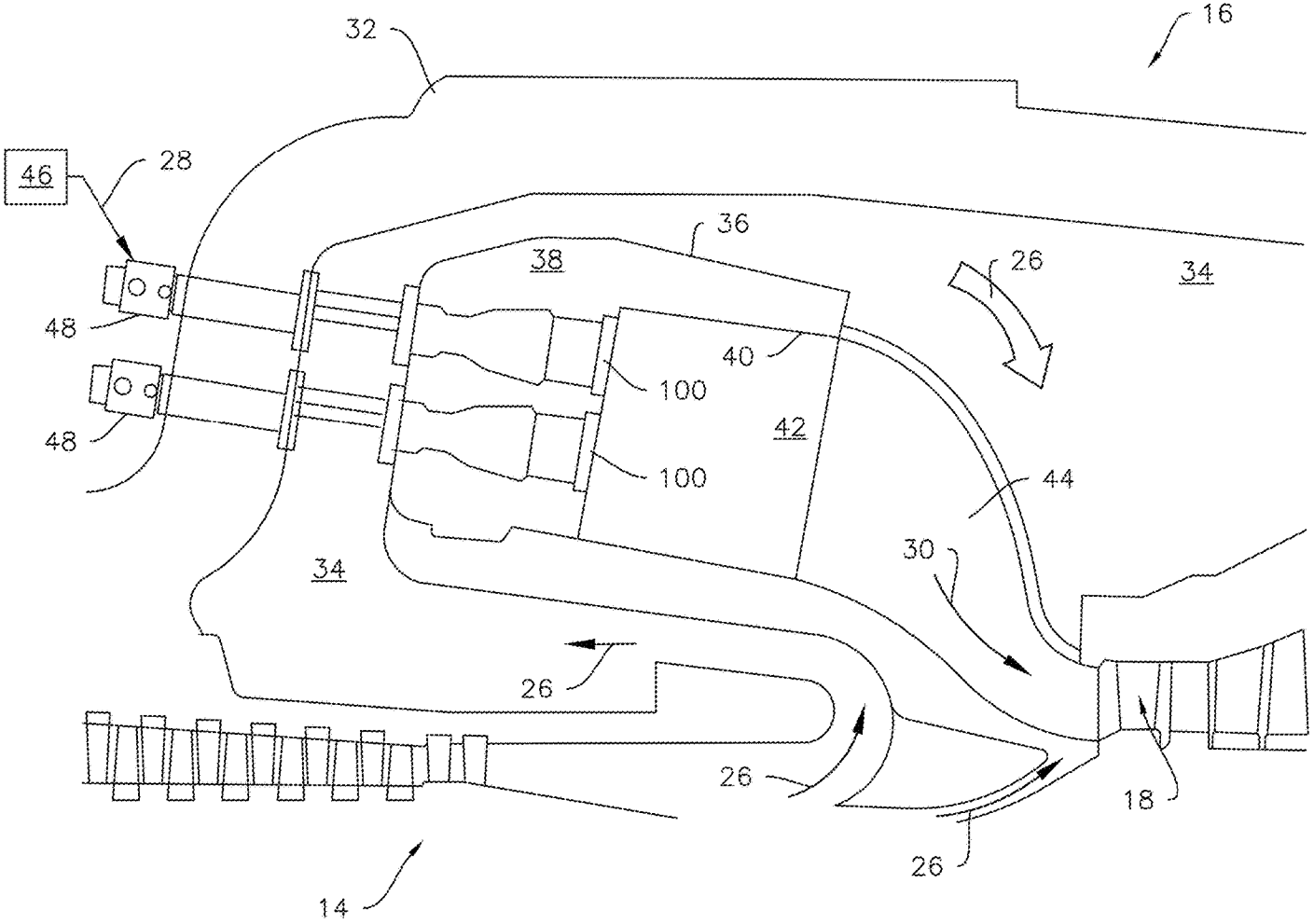
FIG. 3 illustrates a simplified cross-section of a portion of the exemplary combustor section of FIG. 2.

As shown in FIG. 3, the combustor 16 may be at least partially surrounded by an outer casing 32 such as a compressor discharge casing. The outer casing 32 may at least partially define a high pressure plenum 34 that at least partially surrounds various components of the combustor 16. The high pressure plenum 34 may be in fluid communication with the compressor 14 so as to receive the compressed air 26 therefrom. The combustor 16 may be in fluid communication with the compressor 14 such that compressed air 26 flows from the compressor 14 to the combustor 16, e.g., via the high pressure plenum 34. The combustor hood 36 may be positioned within the outer casing 32. In particular embodiments, the combustor hood 36 may at least partially define a head end volume or portion 38 of the combustor 16.

In particular embodiments, the head end portion 38 is in fluid communication with the high pressure plenum 34 and/or the compressor 14. One or more liners or ducts 40 may at least partially define a combustion chamber 42 for combusting the fuel-air mixture and/or may at least partially define a hot gas path 44 through the combustor, for directing the combustion gases 30 towards an inlet to the turbine 18.

In various embodiments, the combustor 16 includes at least one burner fuel gas inlet 48. As shown in FIG. 3, the burner fuel gas inlet 48 may be coupled to the outer casing 32 and extend towards the combustion chamber 42. The one or more burner fuel gas inlet 48 may be in communication with a fuel supply 46. Each burner fuel gas inlet 48 may supply fuel to a respective one of the burners 100.

Figure 4:
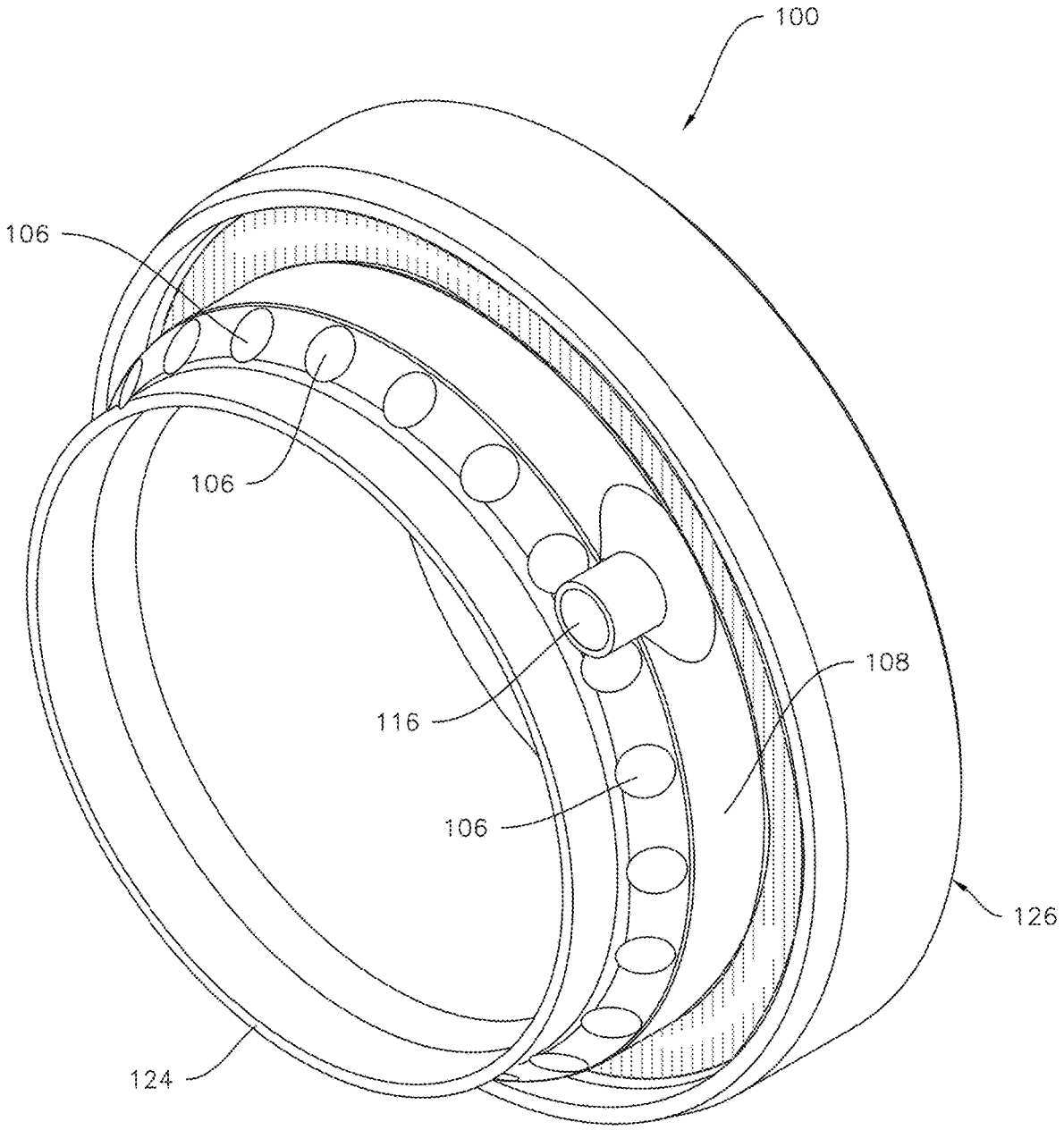
FIG. 4 is a downstream perspective view of a burner according to at least one embodiment.
Figure 6:
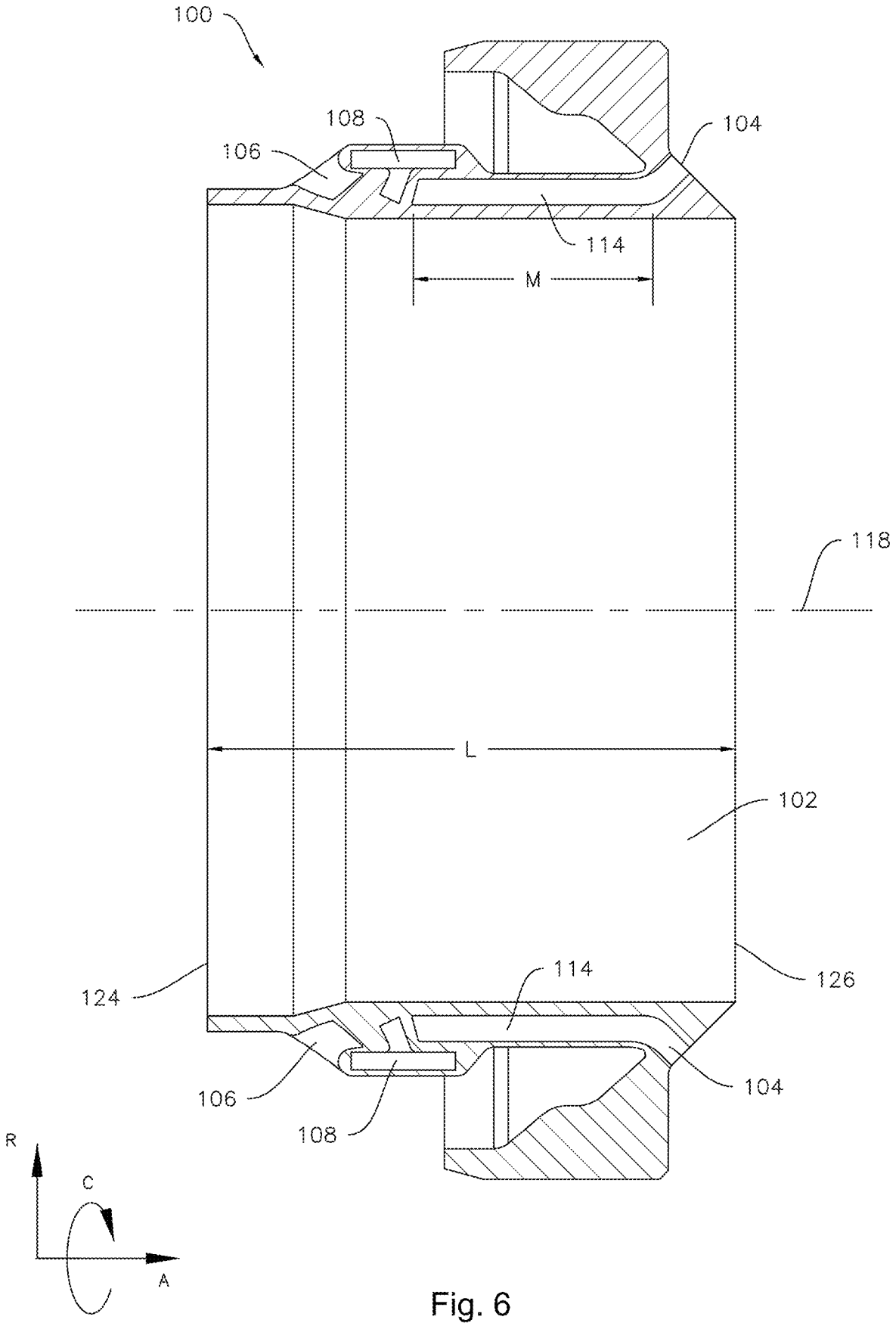
FIG. 6 is a side cross-section of the burner of FIG. 4.

FIG. 4 illustrates a perspective view looking downstream (e.g., from a forward end 124 towards an aft end 126 of the burner 100) of an exemplary burner 100 according to one or more embodiments. As shown in FIG. 4, the exemplary burner 100 includes a fuel gas plenum inlet 116 as may receive a flow of fuel 28 via one of the burner fuel gas inlet 48 (FIG. 3). Fuel gas plenum inlet 116 may feed into an annular fuel plenum 108 which extends around the burner 100 along the circumferential direction C (FIG. 6). The exemplary burner 100 also includes a plurality of air inlets 106 formed in or proximate to the forward end 124 of the burner 100.

Figure 5:
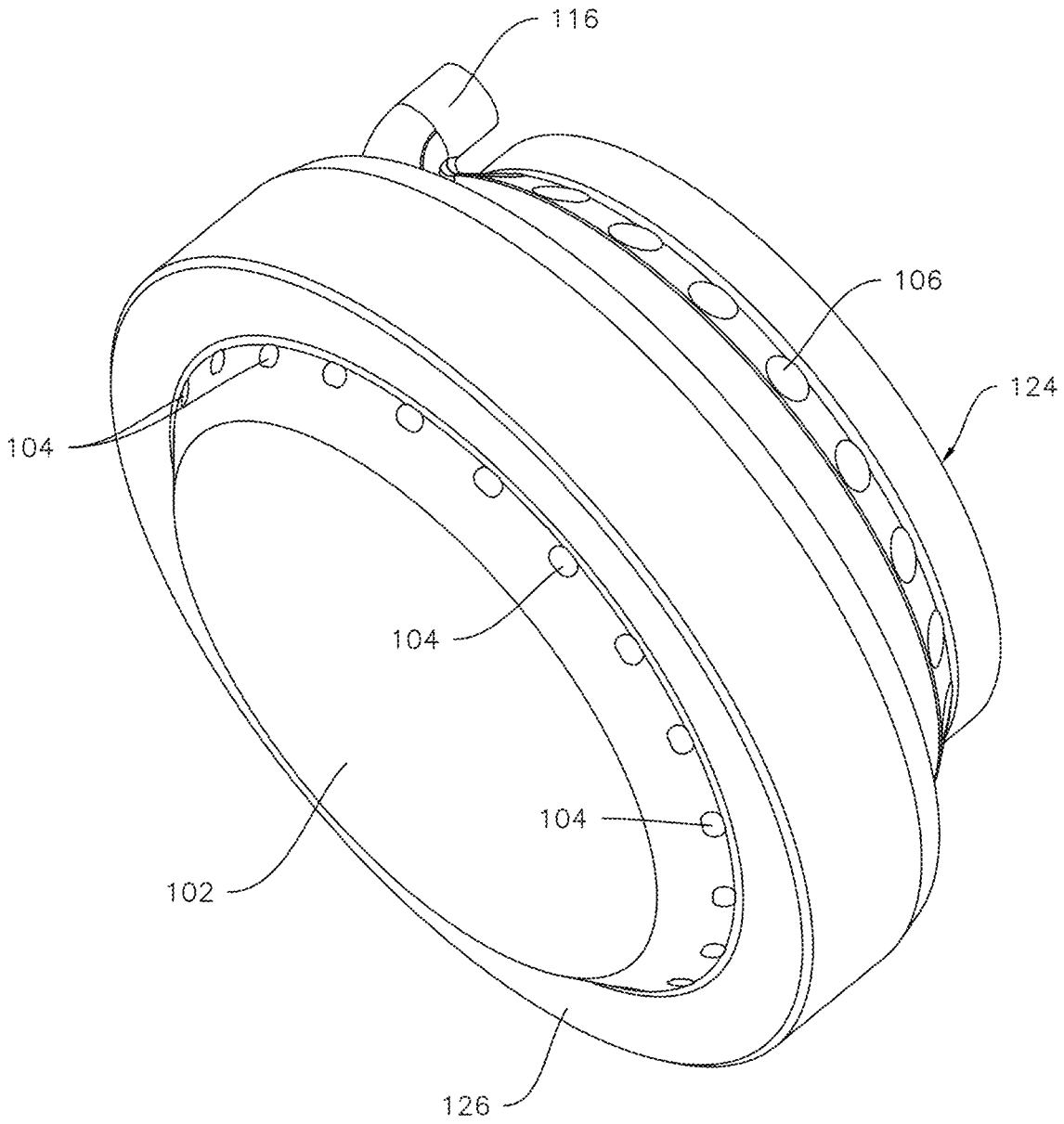
FIG. 5 is an upstream perspective view of the burner of FIG. 4.

FIG. 5 illustrates a perspective view looking upstream (e.g., from aft end 126 towards forward end 124 of the burner 100) of an exemplary burner 100 according to one or more embodiments. As seen in FIG. 5, the burner 100 may include a main nozzle 102. The primary nozzle 102 may be centrally located in or proximate to the aft end 126 of the burner 100. As seen in FIG. 5, a plurality of pilot nozzles 104 may be formed in or proximate to the aft end 126 of the burner 100. The plurality of pilot nozzles 104 may be annularly arranged, e.g., the plurality of pilot nozzles 104 may be spaced along the circumferential direction C (FIG. 6) around the primary nozzle 102.

FIG. 6 illustrates a side section view of an exemplary burner 100 according to one or more embodiments. As illustrated in FIG. 6, the exemplary burner 100 includes a central axis 118 and the central axis 118 of the burner 100 defines an axial direction A, a radial direction R perpendicular to the central axis 118, and a circumferential direction C extending around the central axis 118. As seen in FIG. 6, each of the air inlets 106 is in fluid communication with a respective one of the plurality of pilot nozzles 104. Also seen in FIG. 6, the burner 100 may include a plurality of mixing channels 114 extending along the axial direction A. Each mixing channel 114 of the plurality of mixing channels 114 may extend between a respective air inlet 106 of the plurality of air inlets 106 and a respective pilot nozzle 104 of the plurality of pilot nozzles 104. In such embodiments, each air inlet 106 may be in fluid communication with the respective pilot nozzle 104 via the mixing channel 114. Accordingly, the exemplary burner 100 may provide a plurality of pilot nozzles 104 with in-line mixing. For example, each pilot nozzle 104 may receive a dedicated flow of mixed fuel 28 and air 26 from the corresponding mixing channel 114. Further, each axial mixing channel 114 may be configured for axial mixing of the fuel 28 and air 26 for example, via shear flow in the axial mixing channel 114, as will be described in more detail below. In such embodiments, a mixture of fuel 28 and air 26 may be provided to each pilot nozzle 104 without swirlers, e.g., without swirler vanes or wings.

As may be seen for example, in FIG. 6, in some embodiments, the pilot nozzle 104, the air inlet 106, the mixing channel 114, the annular fuel plenum 108, and the fuel port 110 may be integrally formed of a one-piece seamless construction. For example, in some embodiments, the pilot nozzle 104, the air inlet 106, the mixing channel 114, the annular fuel plenum 108, and the fuel port 110 may be integrally formed via additive manufacturing, such as direct metal laser melting, selective laser sintering, or other suitable additive techniques. As another example, the pilot nozzle 104, the air inlet 106, the mixing channel 114, the annular fuel plenum 108, and the fuel port 110 may be integrally formed by casting the parts as a single piece.

As best seen in FIG. 6, the burner 100 extends along the axial direction A between the forward end 124 and the aft end 126. Accordingly, the burner 100 may define a length L along the axial direction A between the forward end 124 and the aft end 126. Further, each mixing channel 114 of the plurality of mixing channels 114 may define a mixing length M along the axial direction, e.g., generally between the fuel port 110 and the pilot nozzle 104. In particular, the mixing length M may extend from the outlets 112 (FIG. 8) of the fuel port 110 to the respective pilot nozzle 104. In order to promote mixing of the fuel 28 and the air 26, the mixing length M may occupy a substantial portion of the length L of the burner 100, and the mixing length M may occupy a substantial portion of the distance along the axial direction A between the air inlet 106 and the pilot nozzle 104, e.g., the fuel port 110 may be much closer to the air inlet 106 than to the pilot nozzle 104.

Figure 7:
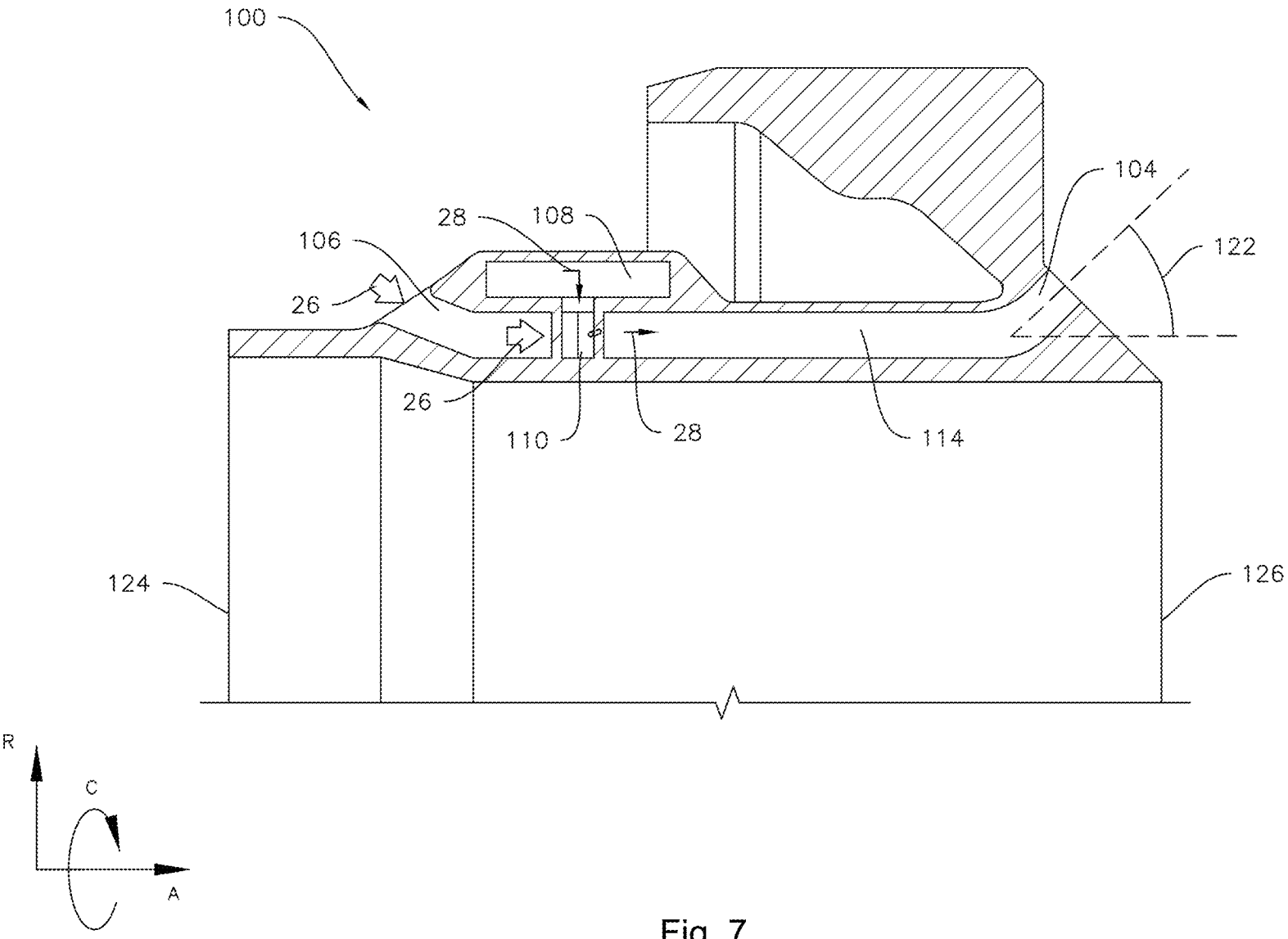
FIG. 7 is a side cross-section of a portion of the burner of FIG. 4.

Turning now to FIG. 7, the exemplary burner 100 may also include a fuel port 110. The fuel port 110 may be in fluid communication with the annular fuel plenum 108 and one mixing channel 114 of the plurality of mixing channels 114. In various embodiments, the fuel port 110 may include an outlet 112 (FIG. 8) configured to inject fuel 28 (FIG. 8) into the mixing channel 114 such that a shear flow is induced. As illustrated in FIG. 7, in some exemplary embodiments, the annular fuel plenum 108 may be spaced radially outward of the mixing channel 114. In such embodiments, the fuel port 110 may extend inward along the radial direction R between the annular fuel plenum 108 and the mixing channel 114. In alternative embodiments, the annular fuel plenum 108 may be spaced radially inward of the mixing channel 114 and the fuel port 110 may extend outward along the radial direction R between the annular fuel plenum 108 and the mixing channel 114.

As may be seen in FIGS. 6 and 7, the pilot nozzle 104 may be oriented oblique to the central axis 118 of the burner 100. In various embodiments, the pilot nozzle 104 may form an angle 122 (FIG. 7) with respect to the central axis 118 of the burner 100. For example, the pilot nozzle 104 may be oriented at an angle 122 between about thirty-five degrees (35°) and about seventy-five degrees (75°) with respect to the central axis 118 of the burner 100, such as between about forty-five degrees (45°) and about sixty-five degrees (65°), such as about fifty-five degrees (55°). As used herein, terms of approximation, such as "about" are to be understood as including within ten percent greater or less than the stated amount. Further, as used herein, such terms in the context of an angle or direction include within ten degrees greater or less than the stated angle or direction.

Figure 8:
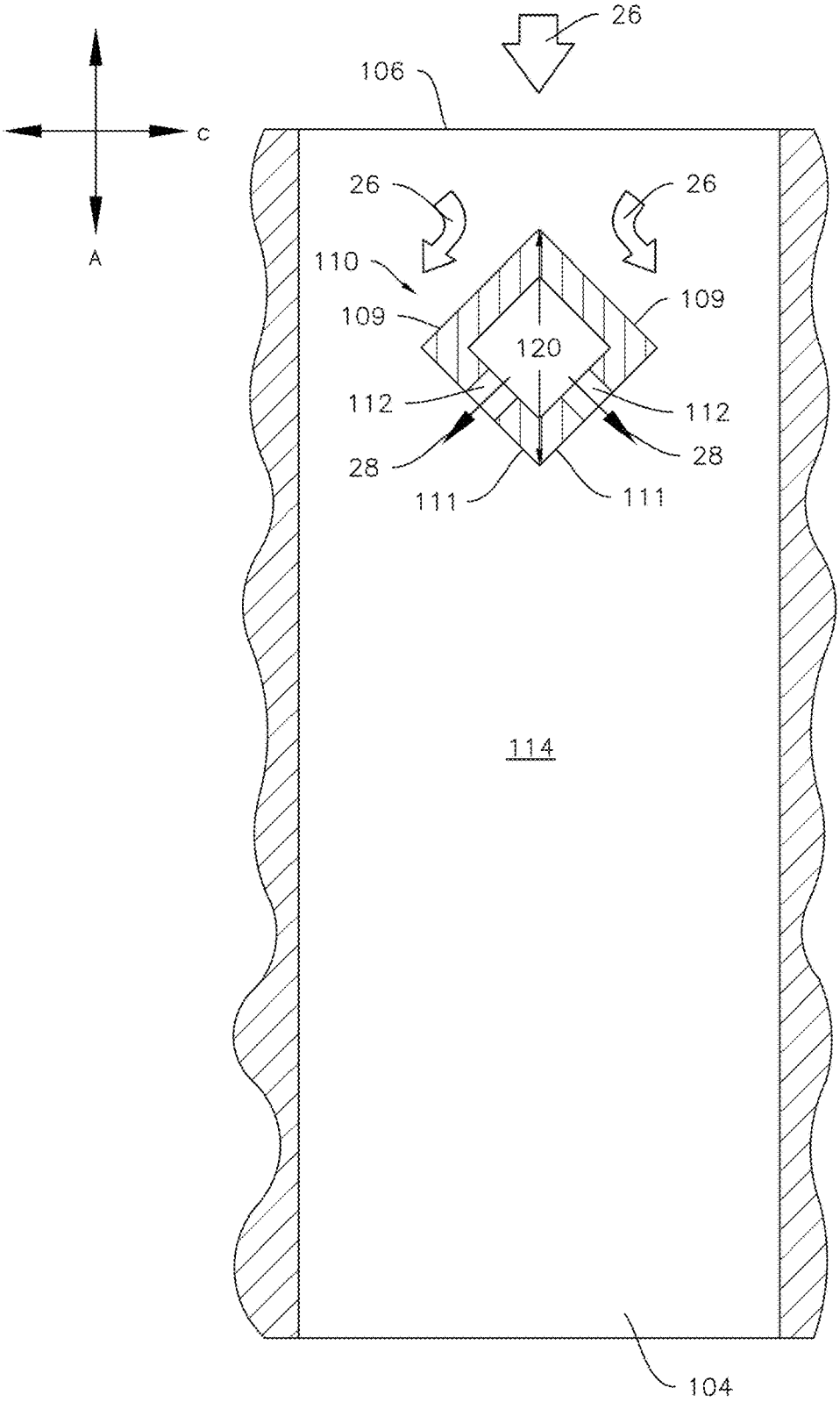
FIG. 8 is a cross-section of a portion of the burner of FIG. 4 looking radially inward.

FIG. 8 illustrates an exemplary section view looking radially inward of the exemplary burner 100. In particular, the illustration of FIG. 8 depicts an exemplary one of the plurality of mixing channels 114 and a respective fuel port 110. As illustrated in FIG. 8, in some embodiments the exemplary fuel port 110 comprises a pair of forward faces 109, e.g., at an upstream end of the fuel port 110. The forward faces may be oriented oblique to the flow of air 26 from air inlet 106. Further, the exemplary fuel port 110 may include a pair of aft faces 111, e.g., opposite the forward faces 109 at a downstream end of the fuel port 110. In some embodiments, the fuel port 110 may include at least one outlet 112, and the outlet 112 of the fuel port 110 may be formed in one of the aft faces 111. As illustrated for example in FIG. 8, some embodiments of fuel port 110 may include two outlets 112, e.g., a first outlet and a second outlet, each outlet 112 formed in a respective one of the pair of aft faces 111. As noted above, the fuel port 110 may be configured to inject fuel 28 into the mixing channel 114 such that a shear flow is induced. For example, providing the outlets 112 in aft faces 111 of the fuel port 110, and in particular in embodiments wherein the aft faces 111 and/or outlets 112 are oblique to the flow of air 26, e.g., such that the flow of fuel 28 into the mixing channel 114 is oblique to the flow of air 26, e.g., around the fuel port 110. Such configurations may provide shear flow within the mixing channel 114, such that fuel 28 and air 26 mix in line with the respective pilot nozzle 104, e.g., to provide in-line mixing as described herein.

Figure 9:
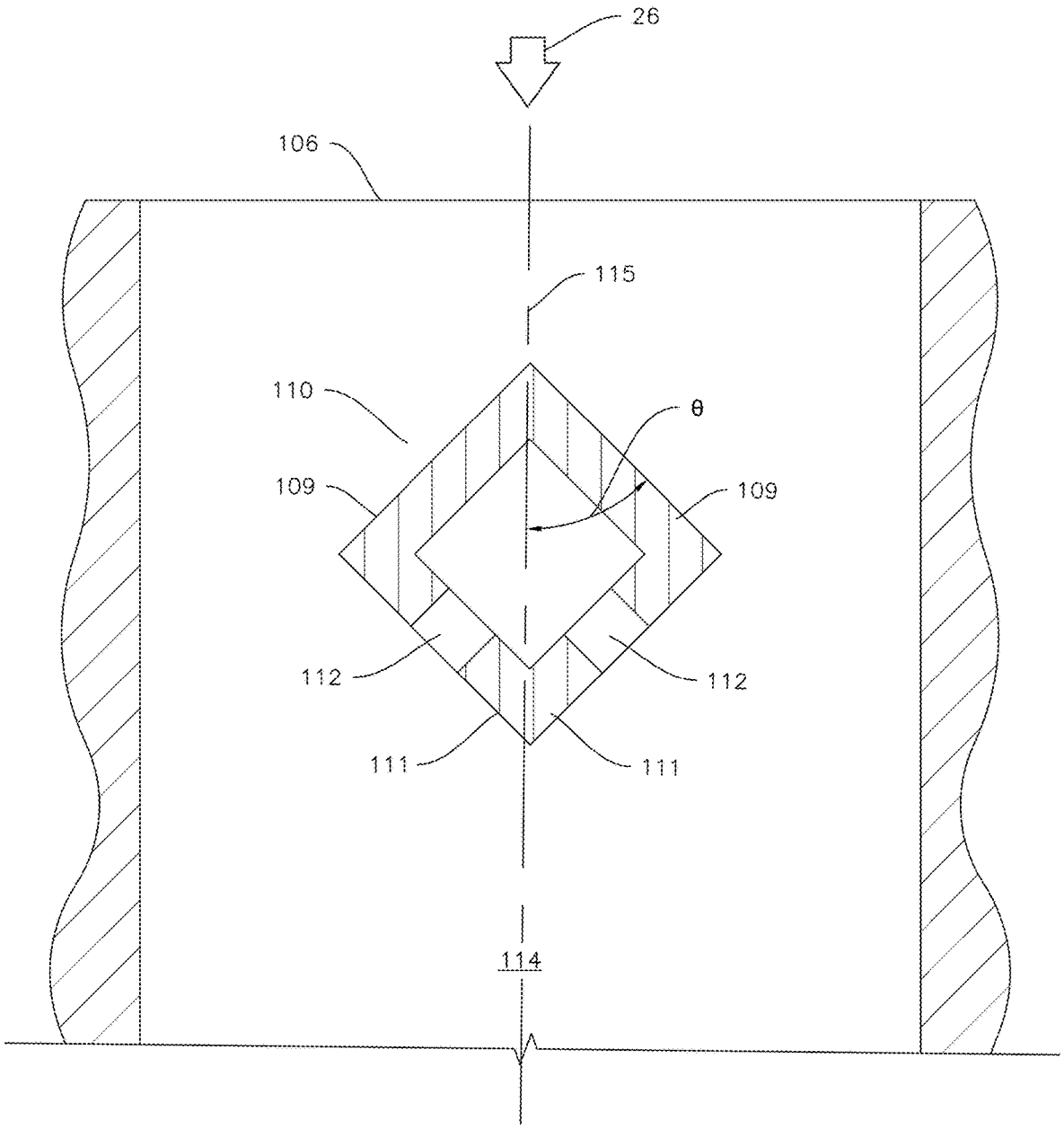
FIG. 9 is an enlarged view of a portion of FIG. 8.

FIG. 9 provides an enlarged view of the exemplary mixing channel 114 illustrated in FIG. 8. As illustrated in FIG. 9, the exemplary air inlet 106 defines an air flow path into the exemplary mixing channel 114, e.g., the air 26 travels from the air inlet 106 into the mixing channel 114 generally along a centerline 115 of the mixing channel 114, at least between the air inlet 106 and the fuel port 110. As shown in FIG. 9, the forward faces 109 of the fuel port 110 are oriented oblique to the centerline 115 of the mixing channel 114 at an angle θ of about forty-five degrees (45°). In various embodiments, the forward faces 109 may be oriented at an angle θ between about five degrees (5°) and about forty-five (45°) with respect to the centerline 115.

Referring again to the illustration of FIG. 8, the fuel port 110 comprises a rectangular cross-section. For example, in the illustrated embodiment of FIG. 8, the fuel port 110 comprises a square cross-section, which is generally understood in the art as an equilateral rectangle. In other embodiments, the fuel port 110 may comprise an oblong rectangle. In various additional embodiments, the fuel port 110 may comprise any suitable cross-section shape, such as but not limited to ovoid, teardrop, hexagonal, etc. Also illustrated in FIG. 8, the cross-section of the fuel port 110 may be oriented such that a diagonal 120 of the cross-section is generally aligned with the air flow path.

The orientation and configuration of the fuel port 110, as shown in FIGS. 8 and 9 and as described in the foregoing paragraphs may provide shear flow within the respective mixing channel 114. For example, the flow of air 26 (FIG. 8) may be diverted around fuel port 110 by the vertex of the cross section shape of the fuel port 110, e.g., at or about an angle θ (FIG. 9) defined by the forward faces 109 of the fuel port 110.

This written description uses examples to disclose the technology, and also to enable any person skilled in the art to practice the technology, including making and using any devices or systems and performing any incorporated methods. The patentable scope of the technology is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

The invention claimed is:

1. A burner for a turbomachine, the burner comprising a central axis, the central axis of the burner defines an axial direction, a radial direction perpendicular to the central axis, and a circumferential direction extending around the central axis, the burner comprising:

a pilot nozzle formed proximate to an aft end of the burner;

an air inlet formed proximate to a forward end of the burner in fluid communication with the pilot nozzle;

a mixing channel defining a centerline and extending along the axial direction between the air inlet and the pilot nozzle such that the air inlet is in fluid communication with the pilot nozzle via the mixing channel;

an annular fuel plenum extending along the circumferential direction; and a fuel port in fluid communication with the annular fuel plenum and the mixing channel, the fuel port comprising a pair of forward faces that are oriented oblique to the centerline of the mixing channel and an outlet that is configured to inject fuel into the mixing channel such that a shear flow is induced.

2. The burner of claim 1, wherein the annular fuel plenum is spaced radially outward of the mixing channel, the fuel port extending inward along the radial direction between the annular fuel plenum and the mixing channel.

3. The burner of claim 1, wherein the fuel port further comprises a pair of aft faces, the outlet of the fuel port being formed in one of the aft faces.

4. The burner of claim 1, wherein the fuel port further comprises a pair of aft faces, and wherein the outlet of the fuel port comprises a first outlet formed in one of the aft faces, the fuel port further comprising a second outlet in the other of the aft faces.

5. The burner of claim 1, wherein the fuel port comprises a rectangular cross-section, the rectangular cross-section of the fuel port being oriented such that a diagonal of the rectangular cross-section is generally aligned with the centerline of the mixing channel.

6. The burner of claim 1, wherein the pilot nozzle is oriented at an angle between about thirty-five degrees and about seventy-five degrees with respect to the central axis of the burner.

7. The burner of claim 1, wherein the pilot nozzle is oriented at an angle of about fifty-five degrees with respect to the central axis of the burner.

8. The burner of claim 1, wherein the pilot nozzle, the air inlet, the mixing channel, the annular fuel plenum, and the fuel port are integrally formed of a one-piece seamless construction.

9. The burner of claim 1, further comprising a plurality of pilot nozzles formed in the aft end of the burner, the pilot nozzles spaced along the circumferential direction, a plurality of mixing channels, each mixing channel in direct fluid communication with only one pilot nozzle, and a plurality of fuel ports, each fuel port of the plurality of fuel ports extending between the annular fuel plenum and a respective one of the mixing channels.

10. A gas turbine, comprising:

a compressor;

a turbine downstream from the compressor;

a combustor disposed downstream from the compressor and upstream from the turbine, the combustor comprising a plurality of burners, each burner comprising:

a pilot nozzle formed proximate to an aft end of the burner;

an air inlet formed proximate to a forward end of the burner in fluid communication with the pilot nozzle;

a mixing channel defining a centerline and extending along an axial direction between the air inlet and the pilot nozzle such that the air inlet is in fluid communication with the pilot nozzle via the mixing channel;

an annular fuel plenum extending along a circumferential direction; and a fuel port in fluid communication with the annular fuel plenum and the mixing channel, the fuel port comprising a pair of forward faces that are oriented oblique to the centerline of the mixing channel and an outlet that is configured to inject fuel into the mixing channel such that a shear flow is induced.

11. The gas turbine of claim 10, wherein the annular fuel plenum is spaced radially outward of the mixing channel, the fuel port extending inward along a radial direction between the annular fuel plenum and the mixing channel.

12. The gas turbine of claim 10, wherein the fuel port further comprises a pair of aft faces, the outlet of the fuel port being formed in one of the aft faces.

13. The gas turbine of claim 10, wherein the fuel port further comprises a pair of aft faces, and wherein the outlet of the fuel port comprises a first outlet formed in one of the aft faces, the fuel port further comprising a second outlet in the other of the aft faces.

14. The gas turbine of claim 10, wherein the fuel port comprises a rectangular cross-section, the rectangular cross-section of the fuel port being oriented such that a diagonal of the rectangular cross-section is generally aligned with the centerline of the mixing channel.

15. The gas turbine of claim 10, wherein the pilot nozzle is oriented at an angle between about thirty-five degrees and about seventy-five degrees with respect to the central axis of the burner.

16. The gas turbine of claim 10, wherein the pilot nozzle is oriented at an angle of about fifty-five degrees with respect to the central axis of the burner.

17. The gas turbine of claim 10, wherein the pilot nozzle, the air inlet, the mixing channel, the annular fuel plenum, and the fuel port are integrally formed of a one-piece seamless construction.

18. The gas turbine of claim 10, further comprising a plurality of pilot nozzles formed in the aft end of the burner, the pilot nozzles spaced along the circumferential direction, a plurality of mixing channels, each mixing channel in direct fluid communication with only one pilot nozzle, and a plurality of fuel ports, each fuel port of the plurality of fuel ports extending between the annular fuel plenum and a respective one of the mixing channels.

* * * * *